US006856781B2

(12) United States Patent
Matsuda et al.

(10) Patent No.: US 6,856,781 B2
(45) Date of Patent: Feb. 15, 2005

(54) IMAGE FORMING APPARATUS AND METHOD OF DEVELOPING AN ELECTROSTATIC LATENT IMAGE

(75) Inventors: Hiroaki Matsuda, Numazu (JP); Yasuaki Iwamoto, Numazu (JP); Hiroshi Nakai, Yokohama (JP); Hiroto Higuchi, Numazu (JP); Bing Shu, Mishima (JP); Maiko Kondo, Numazu (JP); Fumihiro Sasaki, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/077,813

(22) Filed: Feb. 20, 2002

(65) Prior Publication Data

US 2002/0159797 A1 Oct. 31, 2002

(30) Foreign Application Priority Data

Feb. 20, 2001 (JP) ..... 2001-043624
Feb. 15, 2002 (JP) ..... 2002-039109

(51) Int. Cl.[7] ..... G03G 15/08
(52) U.S. Cl. ..... 399/284
(58) Field of Search ..... 399/284, 274

(56) References Cited

U.S. PATENT DOCUMENTS 5,168,312 A * 12/1992 Aoto et al. ..... 399/284
5,519,472 A * 5/1996 Ojima et al. ..... 399/274
5,592,267 A * 1/1997 Misago et al. ..... 399/62
5,682,585 A * 10/1997 Yamaguchi et al. ..... 399/274
6,060,201 A 5/2000 Kinoshita et al.
6,120,960 A 9/2000 Aoki et al.
6,221,549 B1 4/2001 Emoto et al.
6,228,550 B1 5/2001 Matsuda et al.
6,255,028 B1 7/2001 Hasegawa et al.
6,303,257 B1 10/2001 Hasegawa et al.
6,316,156 B1 * 11/2001 Takiguchi et al. ..... 430/109.4
6,335,137 B1 1/2002 Suzuki et al.
6,337,957 B1 1/2002 Tamaka et al.
6,360,068 B1 3/2002 Kinoshita et al.
6,363,229 B1 3/2002 Shiraishi et al.
6,395,443 B2 5/2002 Kuroda et al.
6,403,275 B1 6/2002 Kuramoto et al.
6,406,826 B1 6/2002 Suzuki et al.
6,432,589 B1 8/2002 Uchinokura et al.
6,432,590 B1 8/2002 Ueda et al.
6,442,364 B2 8/2002 Kai et al.
6,468,706 B2 10/2002 Matsuda et al.
6,505,014 B2 1/2003 Aoki et al.
6,507,718 B2 1/2003 Ohjimi et al.
6,684,047 B2 * 1/2004 Kin et al. ..... 399/284

FOREIGN PATENT DOCUMENTS

JP 2000-98709 * 4/2000

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus including a photoconductor, and a developing unit having a developing sleeve for carrying a developer and a developer regulating plate for regulating the amount of the developer carried on the sleeve, wherein the developer is composed of a carrier and a toner, wherein that portion of the toner which has a particle diameter of 2.0–4.0 $\mu$m accounts for 30–70% of a total number thereof, and wherein the developer regulating plate is grounded so that when the developing sleeve is applied with a bias voltage, an electric field is formed between the developer regulating plate and the developing sleeve, whereby toner deposits on the developing sleeve are transferred to the developer regulating plate.

20 Claims, 1 Drawing Sheet

IMAGE FORMING APPARATUS AND METHOD OF DEVELOPING AN ELECTROSTATIC LATENT IMAGE

BACKGROUND OF THE INVENTION

1. Field of the Invention

The present invention relates to an image forming apparatus for use in a copying machine, a facsimile, a laser beam printer, or the like, adapted to form an image by visualizing an electrostatic latent image with a two-component developer containing a mixture of toner and carrier.

2. Discussion of Prior Art

In a known image forming apparatus using electrophotography, an electrostatic latent image is formed on a surface of a photoconductor having a photoconductive layer serving as an image bearing member by exposing the surface of the photoreceptor which has been uniformly charged. Subsequently, the electrostatic latent image on the photoreconductor is developed with toner to form a toner image. The toner image is then transferred to a recording member such as a transfer sheet. The transferred toner image is finally fixed on the recording member by application of heat and pressure.

As the developer, a single component developer composed only of a toner and a two-component developer composed of a toner and a carrier are known. The two-component developer is currently major.

Great endeavor has been made to obtain high grade images with the image forming apparatus. In particular, reproducibility of fine line images and uniformity in density of 100% solid image areas are very important factors. To improve uniformity of the density of solid images, it is effective to use a toner having a small particle diameter and to minimize the maldistribution of charges at peripheries of a latent image for a solid image. The reproducibility of fine line images may be improved by using a toner having particle sizes distributed in a small diameter side, because fine particles are apt to be concentrated in an area, such as a fine line area, in which charges are concentrated.

One problem with the conventional image forming devices using fine toner particles is fouling of a surface of a developer bearing member such as a developing sleeve. When such fouling proceeds, there is formed deposits of the toner adhering on the sleeve surface by fusion. This is usually referred to as filming. Once filming occurs, cleaning of the developing sleeve with jet air is no longer effective and a solvent must be used to clean it.

SUMMARY OF THE INVENTION

It is, therefore, an object of the present invention to provide an image forming apparatus which can produce fine images with high reproducibility and solid images with even density.

Another object of the present invention is to provide an image forming apparatus of the above-mentioned type which does not cause toner filming on the developer bearing member and which can produce high quality images without background stains.

It is a further object of the present invention to provide an image forming method which can produce fine images with high reproducibility and solid images with even density.

It is a further object of the present invention to provide an image forming method which does not cause toner filming on the developer bearing member and which can produce high quality images without background stains.

In accomplishing the foregoing objects, there is provided in accordance with one aspect of the present invention an image forming apparatus, which comprises a latent image bearing member;

a developer bearing member disposed adjacent to the latent image bearing member to define a developing zone therebetween, the developer bearing member being configured to carry a two-component developer including a toner and a carrier on its surface and to convey the developer to the developing zone, so that the latent image on the latent image bearing member is developed with the toner in the developing zone; and a developer regulating member configured to regulate the amount of the developer carried and conveyed by the developer bearing member toward the developing zone, wherein that portion of the toner which has a particle diameter of 2.0–4.0 $\mu$m accounts for 30–70% of a total number thereof, and wherein the developer regulating member is grounded such that when the developer bearing member is applied with a bias voltage, an electric field is formed between the developer regulating member and the developer bearing member, whereby toner deposits on the developer bearing member are transferred to the developer regulating member.

In another aspect, the present invention provides a method of developing an electrostatic latent image on an image bearing member, comprising:

feeding a two-component developer including a toner and a carrier to a developing unit having a developing member to permit the developing member to bear the developer;

contacting the developer carried by the developing member with a developer regulating member to regulate the amount of the developer carried by the developing member; and while applying a bias voltage to said developing member, contacting the developer whose amount has been regulated by the developer regulating member with the latent image on the image bearing member to develop the latent image with the toner;

wherein that portion of the toner which has a particle diameter of 2.0–4.0 $\mu$m accounts for 30–70% of a total number thereof, and wherein the developer regulating member is grounded such that when the developing member is applied with the bias voltage, an electric field is formed between the developer regulating member and the developing member, whereby toner deposits on the developing member are transferred to the developer regulating member.

It has been found that toner filming on a developer-bearing member (developing member) such as a developing sleeve is attributed partly to poor fluidity of fine toner particles. Once fine toner particles deposit on the developing sleeve, they are not readily adhered to carrier particles. Further, grooves and other roughness of the developing sleeve surface will accelerate the trapping of the toner particles. It has also been found that when a two-component developer used has a toner having a large proportion of fine particles and when a developer regulating member (a doctor blade) used to regulate the amount or thickness of the developer carried by the developer sleeve is grounded to form an electric field between the doctor blade and the developing sleeve, fouling of the developing sleeve with the toner can be prevented while uniformity of the optical density of a 100% solid image can be improved.

BRIEF DESCRIPTION OF THE DRAWING

Other objects, features and advantages of the present invention will become apparent from the detailed description of the preferred embodiments of the invention which follows, when considered in the light of the accompanying drawings, in which.

DETAILED DESCRIPTION OF THE PREFERRED EMBODIMENTS OF THE INVENTION

Figure 1:
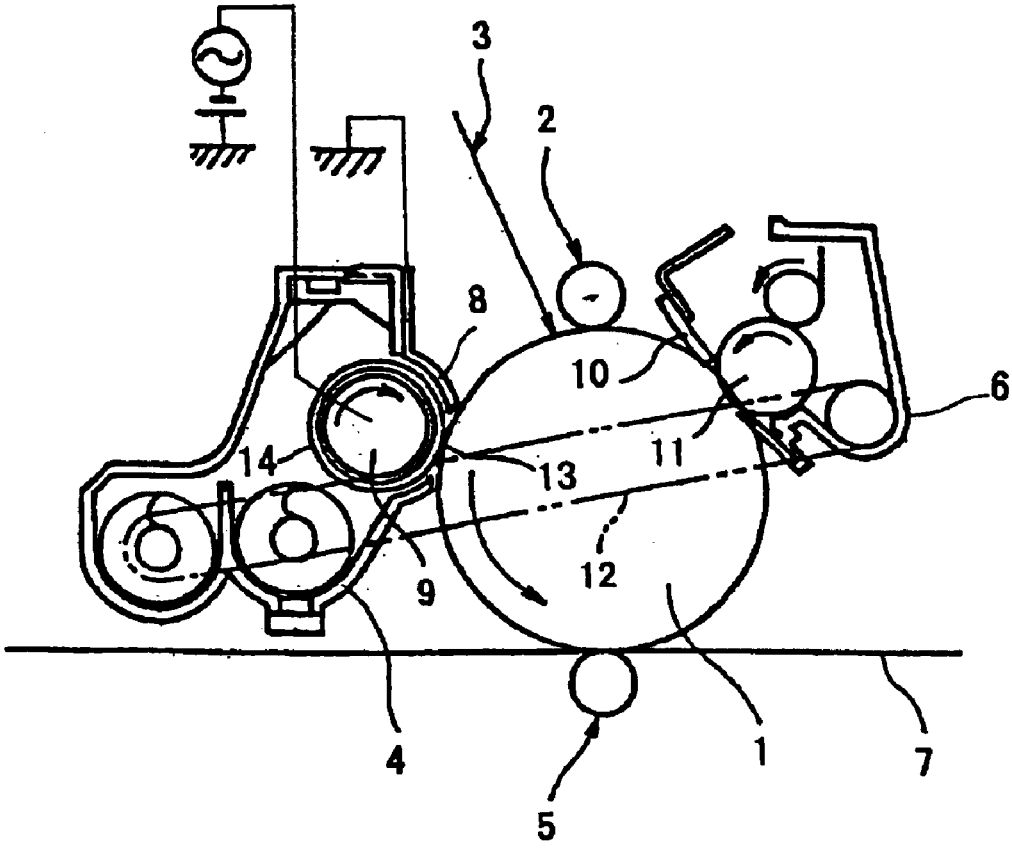
FIG. 1 is a schematic illustration of an essential part of an image forming apparatus according to the present invention.

Referring now to FIG. 1, designated as 1 is a latent image bearing member such as a photoconductor drum. Disposed adjacent to the photoconductor drum 1 are a charger 2 for charging a surface of the photoconductor drum 1 and an exposing member 3 for irradiating light on the charged surface of the drum 1 to form an electrostatic image thereon. The image bearing member 1 may be in the form of a sheet or an endless belt, if desired. The charger 2 may be conventional means such as a corotron charger, a scorotron charger, a solid state charger, and a charging roller. As the light source of the exposing member 3, there can be employed, for example, a fluorescent tube, tungsten lamp, halogen lamp, mercury vapor lamp, sodium lamp, light emitting diode (LED), semiconductor laser (LD) or electroluminescence (EL).

A developer bearing member 9 such as a developing cylinder is disposed adjacent to the latent image bearing member 1 to define a developing zone 13 therebetween. The developing cylinder 9 is adapted to carry a two-component developer 14 contained in a developer vessel 4 and to convey the developer 14 to the developing zone 13, so that the latent image on the photoconductive drum 1 is developed with the toner of the developer 14 to form a toner image.

A developer regulating member 8 such as a doctor blade is provided to regulate the amount of the toner carried and conveyed by the developing cylinder 9. The developer regulating member 8 is grounded so that when the developing cylinder 9 is applied with a bias voltage, an electric field is formed between the developer regulating member 8 and the developing cylinder 9, whereby toner deposits on the developing cylinder 9 are transferred to the developer regulating member 8.

The toner image on the photoconductor drum 1 is transferred to an intermediate transfer member 7 by a transfer means 5 and the transferred image is further transferred to an image receiving member such as a paper (not shown) and is then fixed thereto by a fixing device (not shown). The intermediate transfer member 7 may be omitted and the toner image on the photoconductor drum 1 may be directly transferred to an image receiving member, if desired.

In the step of image transfer, all the toner particles deposited on the photoconductor drum 1 are not transferred to the intermediate transfer member 7. Some toner particles remain on the surface of the photoconductor drum 1. The remaining toner particles are removed from the photoconductor drum 1 using a fur brush 11 and a cleaning blade 10. The cleaning of the photoconductor may be carried out only by use of a cleaning brush. As the cleaning brush, there can be employed a conventional fur brush and magnetic fur brush. The toner particles thus recovered are collected in a tank 6. The collected toner may be recycled through a recycling path 12 such as a toner guide screw pipe to the developer vessel 4.

The two-component developer used in the present invention includes a toner and a carrier. It is important that 30–70% of a total number of the toner particles have a particle diameter of 2.0–4.0 $\mu$m. Preferably, the toner has a number average particle diameter of 3–7 $\mu$m and a weight average particle diameter of 4–8 $\mu$m.

As used herein, the particle diameter distribution of the toner is measured with a Coulter counter TA-II (manufactured by Coulter Electronics, Inc.) to which an interface (manufactured by Nikkaki Inc.) capable of outputting number-based and volume-based distribution and a personal computer (IBM Inc.) are connected. As an electrolytic solution for measurement, an aqueous 1% by weight NaCl solution of first-grade sodium chloride is used (such as ISOTONR-II available from Coulter Scientific, Japan Inc.). A dispersant (0.1–5 ml of a salt of alkylbenzenesulfonic acid) is added to 100 to 150 ml of the above electrolytic solution, to which 2 to 20 mg of a sample to be measured are added. The resulting mixture is subjected to a dispersing treatment for about 1–3 minute to about 3 minutes in an ultrasonic dispersing machine. Using an aperture of 100 $\mu$m in the above particle size distribution measuring device, the particle size distribution is measured on the basis of the particle number with the Coulter counter for particles having a diameter in the range of 2–40 $\mu$m. The number and volume particle distribution are calculated. The weight average diameter of the toner is determined from that volume distribution.

The toner includes a colorant and a binder resin. Any conventional binder may be used for the purpose of the present invention. Examples of the binder resins include a styrene-based resin such as polystyrene, poly(p-chlorostyrene), poly(vinyltoluene), a styrene-p-chlorostyrene copolymer, a styrene-vinyltoluene copolymer, a styrene-propylene copolymer, a styrene-vinylnaphthalene copolymer, a styrene-methyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl a-chloromethacrylate copolymer, a styrene-acrylonitrile copolymer, a styrene-vinyl methyl ketone copolymer, a styrene-vinyl methyl ether copolymer, a styrene-vinyl ethyl ether copolymer, a styrene-butadiene copolymer, a styrene-isoprene copolymer, a styrene-acrylonitrile-indene terpolymer, a styrene-butadiene-isoprene terpolymer, a styrene-maleic acid copolymer or a styrene-maleate copolymer; poly(vinyl chloride); and other resins such as a phenol resin, a natural resin-modified phenol resin, a natural resin-modified maleic acid resin, an acrylic or methacrylic resin (e.g. a poly(acrylic acid) resin, a poly(methyl acrylate) resin, a poly(methyl methacrylate) resin or a poly(butyl methacrylate) resin), a poly(vinyl acetate) resin, a silicone resin, a polyester resin, a polyurethane resin, a polyamide resin, an epoxy resin, a xylene resin, a furan resin, a coumarone-indene resin, a poly(vinyl butyral) resin, rosin, modified rosin, a terpene resin, an aliphatic or alicyclic hydrocarbon resin, an aromatic petroleum resin, chlorinated paraffin, or paraffin wax. These binder resins may be used by themselves or as a mixture of two or more.

The binder resin may be used in combination with an olefin polymer or copolymer as a fixation aid. Illustrative of suitable olefin polymers and copolymers are polyethylene, polypropylene, ethylene-propylene copolymers, ethylene-vinyl acetate copolymers, ethylene-ethyl acrylate copolymers and ionomers having a polyethylene skeleton. The olefin monomer content of the copolymers is preferably at least 50 mole %, more preferably at least 60 mole %.

The binder resin is preferably a mixture of a styrene-acrylic copolymer resin with a polyester resin. The mixture preferably contains the styrene-acrylic copolymer resin in an amount of 5–50 parts by weight, more preferably 10–20 parts by weight, per 100 parts by weight of the polyester resin.

The suitable styrene-acrylic copolymer resin is a copolymer of styrene or its homologue with one or more alkyl (including branched alkyl and cycloalkyl) acrylates or methacrylates. The alkyl generally has 1–12 carbon atoms.

The polyester resin is a polycondensation product of a polyol with a polyacid. The polyol may be a diol or a tri- or more polyhydric alcohol. As the diol to be used for the preparation of the base polyester, any diol employed conventionally for the preparation of polyester resins can be employed. Preferred examples include alkylene glycols such as ethylene glycol, 1,2-propylene glycol, 1,3-propylene glycol, 1,3-butylene glycol, 1,4-butylene glycol, 2,3-butanediol, diethylene glycol, triethylene glycol, dipropylene glycol, 1,5-pentanediol, 1,6-hexanediol, neopentyl glycol and 2-ethyl-1,3-hexanediol; alkyleneether glycols such as diethylene glycol, triethylene glycol, dipropylene glycol, polyethylene glycol, polypropylene glycol and polytetramethylene ether glycol; alicyclic glycols such as 1,4-cyclohexane dimethanol and hydrogenated bisphenol A; bisphenols such as bisphenol A, bisphenol F and bisphenol S; alkylene oxide adducts (e.g. ethylene oxide, propylene oxide and butylene oxide adducts) of the above alicyclic diols; and alkylene oxide adducts (e.g. ethylene oxide, propylene oxide and butylene oxide adducts) of the above bisphenols. Above all, alkylene glycols having 2–12 carbon atoms and alkylene oxide adducts of bisphenols are preferred. Especially preferred is the use of a mixture of alkylene glycols having 2–12 carbon atoms with alkylene oxide adducts of bisphenols.

Examples of the polyol having three or more hydroxyl groups include polyhydric aliphatic alcohols such as glycerin, 2-methylpropane triol, trimethylolpropane, trimethylolethane, pentaerythritol, sorbitol and sorbitan; phenol compounds having 3 or more hydroxyl groups such as trisphenol PA, phenol novolak and cresol novolak; and alkylene oxide adducts of the phenol compounds having 3 or more hydroxyl groups.

The polyacid may be a dicarboxylic acid, tri- or more polybasic carboxylic acid or a mixture thereof.

As the dicarboxylic acid to be used for the preparation of the base polyester, any dicarboxylic acid conventionally used for the preparation of a polyester resin can be employed. Preferred examples include alkyldicarboxylic acids such as malonic acid, succinic acid, glutaric acid, adipic acid, azelaic acid and sebacic acid; alkenylene dicarboxylic acids such as maleic acid, fumaric acid, citraconic acid and itaconic acid; and aromatic dicarboxylic acids such as phthalic acid, terephthalic acid, isophthalic acid and naphthalene dicarboxylic acid. Above all, alkenylene dicarboxylic acids having 4–20 carbon atoms and aromatic dicarboxylic acids having 8–20 carbon atoms are preferably used.

Examples of tri- or more polybasic carboxylic acids include aromatic polybasic carboxylic acids having 9–20 carbon atoms such as trimellitic acid and pyromellitic acid. The polyacids may be in the form of anhydrides or low alkyl esters (e.g. methyl esters, ethyl esters and isopropyl esters).

The binder resin preferably has a glass transition point Tg of 63° C. or less for reasons of low temperature fixation. Hitherto, such a resin has not been actually used because the resulting toner is apt to cause toner filming on a developing sleeve. Since, in the present invention, the toner has a specific particle size distribution and since a developer regulating member (a doctor blade) is grounded to form an electric field between the doctor blade and the developing sleeve, toner filming can be prevented even when a binder resin having Tg of 63° C. or less is used.

Any known colorant may be used for the purpose of the invention. The colorant may be a black colorant such as carbon black, aniline black, furnace black, lamp black or iron black; a cyan colorant such as phthalocyanine blue, methylene blue, Victoria blue, methyl violet, ultramarine blue or aniline blue; a magenta colorant such as rhodamine 6G lake, dimethylquinacridone, watching red, rose bengal, rhodamine B or alizarin lake; or a yellow pigment such as chrome yellow, benzidine yellow, Hansa yellow G, naphthol yellow, quinoline yellow, azomethylene yellow or tartrazine. These colorants may be used by themselves or in combination with two or more for each color.

The amount of the coloring agent is not specifically limited but is generally in the range of 0.1–30 parts by weight, preferably 2–10 parts by weight, per 100 parts by weight of the binder resin in the case of a pigment. In the case of a dye such as an azo dye, an anthraquinone dye, xanthene dye or a methyne dye, the amount is generally 0.05–10 parts by weight, preferably 0.1–3 parts by weight, per 100 parts by weight of the binder resin.

The toner may contain a customarily employed charge controlling agent as an internal or external additive. Suitable charge controlling agents are organometallic compounds and chelate compounds such as metal acetylacetonate complexes, metal monoazo complexes, metal naphthoic acid complexes and metal salicylic acid complexes. Specific examples of charge controlling agents include aluminum acetylacetonate, iron(II) acetylacetonate and 3,5-di-t-butylsalicylic acid complexes of chromium or zirconium. The charge controlling agent is in the form of particles having a number average diameter of 3 $\mu$m or less and is generally used in an amount of 0.1–20 parts by weight, preferably 0.2–10 parts by weight, per 100 parts by weight of the binder resin.

The toner may also contain one or more additives, if desired. Illustrative of additives are a flowability improving agent (caking-prevention agent) such as fine particles of metal oxides and ceramics (e.g. cerium oxide, zirconium oxide, silicon oxide, titanium oxide, zinc oxide, antimony oxide, tin oxide, aluminum oxide, silicon carbide and silicon nitride); a cleaning aid such as fine resin particles or a metal soap lubricant (e.g. fluorine resin, silicone resin, acrylic resin, zinc stearate, calcium stearate, aluminum stearate and magnesium stearate). The use of silicon oxide and/or titanium oxide as the flowability improving agent is especially preferred. The flowability improving agent may be preferably pretreated with an organosilicon compound such as a silicone vanish, a modified silicone vanish, modified silicone oil, a silane coupling agent or a functional group-bearing silane coupling agent. As the cleaning aid, the use of zinc stearate is especially preferred.

A release agent such as solid silicone vanish, higher aliphatic alcohol, a low molecular weight polypropylene, a low molecular weight polyethylene, carnauba wax, microcrystalline wax, paraffin wax, rice wax, hohoba wax, sazol wax or montaic acid wax may also be incorporated into the toner to improve releasability during the image fixing step. The amount of the release agent is generally 0.1–10 parts by weight per 100 parts by weight of the binder resin.

The following examples will further illustrate the present invention. Parts and percentages are by weight except otherwise specifically noted.

| Preparation of Toner (A): | |
|---|---|
| Polyester resin 1 (MW: 12,000, Mw/Mn: 3.7, acid value: 8, hydroxyl value: 28, Tg: 55° C.) | 100 parts |
| Carnauba wax (melting point: 82° C., acid value: 2) | 3 parts |
| Carbon black (tradenamed as #44, manufactured by Mitsubishi Chemical Corp.) | 8 parts |
| Zirconium compound ($Zr(3\text{-}5\text{-t-butylsalicylic acid})_4$) | 2 parts |

The above components were mixed using a Henschel mixer. The mixture was heated at a temperature of from 130 to 140° C. and kneaded for about 30 minutes using a roll mill. The kneaded mixture was cooled, pulverized using a jet mill and classified. To the resulting particles (100 parts), 1.5 parts of hydrophobic silica (R972 manufactured by Nihon Aerosil Inc.) as an external additive, mixed using Henschel mixer and classified to remove large particles, thereby obtaining Toner (A) having a number average particle diameter of 4.60 μm and a weight average particle diameter of 6.50 μm and containing 40.4% by number of particles having 2–4 μm. The particle size distribution of Toner (A) measured by TA-II is shown in Table 1.

TABLE 1

| Channel | Diameter Range | Number of Particles | Number Distribution | Volume Distribution |
|---|---|---|---|---|
| 1 | 1.26–1.59 | 0 | 0.00 | 0.00 |
| 2 | 1.59–2.00 | 0 | 0.00 | 0.00 |
| 3 | 2.00–2.52 | 2492 | 8.31 | 0.67 |
| 4 | 2.52–3.17 | 3549 | 11.83 | 1.92 |
| 5 | 3.17–4.00 | 6083 | 20.28 | 6.58 |
| 6 | 4.00–5.04 | 7442 | 24.81 | 16.11 |
| 7 | 5.04–6.35 | 6305 | 21.02 | 27.29 |
| 8 | 6.35–8.00 | 3145 | 10.48 | 27.22 |
| 9 | 8.00–10.1 | 841 | 2.80 | 14.56 |
| 10 | 10.1–12.7 | 127 | 0.42 | 4.40 |
| 11 | 12.7–16.0 | 14 | 0.05 | 0.97 |
| 12 | 16.0–20.2 | 2 | 0.01 | 0.28 |
| 13 | 20.2–25.4 | 0 | 0.00 | 0.00 |
| 14 | 25.4–32.0 | 0 | 0.00 | 0.00 |

| Preparation of Toner (B): | |
|---|---|
| Polyester resin 1 (Mw: 12,000, Mw/Mn: 3.7, acid value: 8, hydroxyl value: 28, Tg: 55° C.) | 90 parts |
| Styrene-butyl methacrylate copolymer (Mw: 150,000) | 10 parts |
| Carnauba wax (melting point: 82° C., acid value: 2) | 3 parts |
| Carbon black (tradenamed as #44, manufactured by Mitsubishi Chemical Corp.) | 8 parts |
| Zirconium compound ($Zr(3\text{-}5\text{-t-butylsalicylic acid})_4$) | 2 parts |

The above components were mixed using a Henschel mixer. The mixture was heated at a temperature of from 130 to 140° C. and kneaded for about 30 minutes using a roll mill. The kneaded mixture was cooled, pulverized using a jet mill and classified. To the resulting particles (100 parts), 1.5 parts of hydrophobic silica (R972 manufactured by Nihon Aerosil Inc.) as an external additive, mixed using Henschel mixer and classified to remove large particles, thereby obtaining Toner (B) having a number average particle diameter of 4.21 μm and a weight average particle diameter of 6.34 μm and containing 53.5% by number of particles having 2–4 μm. The particle size distribution of Toner (B) measured by TA-II is shown in Table 2.

TABLE 2

| Channel | Diameter Range | Number of Particles | Number Distribution | Volume Distribution |
|---|---|---|---|---|
| 1 | 1.26–1.59 | 0 | 0.00 | 0.00 |
| 2 | 1.59–2.00 | 0 | 0.00 | 0.00 |
| 3 | 2.00–2.52 | 4056 | 13.52 | 1.33 |
| 4 | 2.52–3.17 | 5726 | 19.09 | 3.76 |
| 5 | 3.17–4.00 | 6272 | 20.91 | 8.24 |
| 6 | 4.00–5.04 | 6226 | 20.75 | 16.36 |
| 7 | 5.04–6.35 | 4247 | 14.16 | 22.32 |
| 8 | 6.35–8.00 | 2584 | 8.61 | 27.16 |
| 9 | 8.00–10.1 | 793 | 2.64 | 16.67 |
| 10 | 10.1–12.7 | 93 | 0.31 | 3.91 |
| 11 | 12.7–16.0 | 3 | 0.01 | 0.25 |
| 12 | 16.0–20.2 | 0 | 0.00 | 0.00 |
| 13 | 20.2–25.4 | 0 | 0.00 | 0.00 |
| 14 | 25.4–32.0 | 0 | 0.00 | 0.00 |

Copying Machine:

An electrophotographic copying machine (IMAGIO MF4570 manufactured by Ricoh Company, Ltd.) was modified as follows:

(a) one end of a lead wire was electrically connected via an ON-Off switch to a doctor blade of the copying machine and the other end was grounded; and (b) waste toner tank was connected to a toner recycling path of the copying machine such that toner recovered from the photoconductor was either (1) returned to the developing zone or (2) collected in the waste toner tank, selectively.

The gap between the doctor blade and the developing cylinder was adjusted to 0.34 mm or 0.48 mm.

| Preparation of Coating Material for Carrier: | |
|---|---|
| Dimethylsilicone resin S (toluene solution, solid matter: 20%) | 600 parts |
| Toluene | 400 parts |
| γ-(2-Aminoethyl)aminopropyltrimethoxysilane (SH6020 manufactured by Toray·Dowcorning Silicone Inc.) | 10 parts |
| Carbon black (BP-2000, manufactured by Cabot Company Ltd.) | 12 parts |

The above components were mixed and thoroughly dispersed with a homomixer to obtain Coating Liquid (I).

| Preparation of Carrier (I): | |
|---|---|
| Ferrite carrier core material (F-300 manufactured by Powdertech Inc.) | 5000 parts |
| Coating Liquid (I) above | 1022 parts |
| Tin catalyst $(CH_3H_7)_2Sn(OCOCH_3)_2$ (10% toluene solution) | 16.8 parts |

The above ferrite carrier core material was placed on a rotary bottom disc of a fluidized bed. The disc was rotated at a speed of 150 revolutions per minute to form a vortex. When the vortex was stabilized, Coating Liquid (I) was sprayed into the vortex. The resulting coated carrier was heated at 300° C. for 2 hours in an electric oven to obtain Carrier (I) having true specific gravity of 5.0 and a weight average particle diameter of 55 μm.

EXAMPLE 1

4 Parts of Toner (A) obtained above and 96 parts of Carrier (I) obtained above were thoroughly mixed with a Turbler mixer to obtain a developer. This was charged in a developing unit of the above copying machine (IMAGIO MF4570) in which the doctor blade was grounded, the gap between the doctor blade and the developing cylinder was adjusted to 0.34 mm and the toner-recycling path was connected to the waste toner collecting tank. The copying machine was operated to obtain 50,000 copies. Thereafter, three copies of 100% solid image (A3 size) and three copies of 100% white image (A3 size) were produced to evaluate the uniformity in the density of the solid images and the background stains of the white images. The results are summarized in Table 3. Good results are obtained. Uniformity in density is represented by a difference between the maximum and minimum optical densities. A value of less than 0.20 is desired. In evaluation of the background stains, rank 5 is the best and indicates that no stains are observed, while rank 1 is the worst and indicates remarkable stains. Stains of Rank 3 or less is not permissible. After the production of copies, the developing sleeve was observed with naked eyes. The sleeve was found to be clean as in the initial state.

EXAMPLE 2

Example 1 was further continued. Thus, after the copying machine had been set so that the recovered toner was recycled to the developing unit, 50,000 copies were produced. Then, three copies of 100% solid image (A3 size) and three copies of 100% white image (A3 size) were produced to evaluate the uniformity in the density of the solid images and the background stains of the white images. The results are summarized in Table 3. Good results are obtained. After the production of copies, the developing sleeve was observed with naked eyes. The sleeve was found to be clean as in the initial state.

EXAMPLE 3

The copying machined after Example 2 was cleaned into the state similar to that before the start of the test in Example 1. To the cleaned machine, a developer obtained by mixing 4 parts of Toner (B) obtained above and 96 parts of Carrier (I) obtained above using a Turbler mixer was charged. The doctor blade was grounded, the gap between the doctor blade and the developing cylinder was adjusted to 0.34 mm and the toner recycling path was connected to the developing unit in the same manner as that in Example 2. The copying machine was operated to obtain 50,000 copies. Thereafter, three copies of 100% solid image (A3 size) and three copies of 100% white image (A3 size) were produced to evaluate the uniformity in the density of the solid images and the background stains of the white images. The results are summarized in Table 3. Better results were obtained with respect to the background stains as compared with the case of Example 2, though the uniformity of the density of the solid image was not. After the production of copies, the developing sleeve was observed with naked eyes. The sleeve in the non-image region was found to be slightly fouled, though in a permissible level.

EXAMPLE 4

4 Parts of Toner (A) obtained above and 96 parts of Carrier (I) obtained above were thoroughly mixed with a Turbler mixer to obtain a developer. This was charged in a developing unit of the above copying machine (IMAGIO MF4570) in which the doctor blade was grounded, the gap between the doctor blade and the developing cylinder was adjusted to 0.48 mm and the toner recycling path was connected to the waste toner collecting tank. The copying machine was operated to obtain 50,000 copies. Thereafter, three copies of 100% solid image (A3 size) and three copies of 100% white image (A3 size) were produced to evaluate the uniformity in the density of the solid images and the background stains of the white images. The results are summarized in Table 3. Good results are obtained. After the production of copies, the developing sleeve was observed with naked eyes. The sleeve was found to be clean as in the initial state though slight fouling was detected at side ends.

COMPARATIVE EXAMPLE 1

The copying machined after Example 3 was cleaned into the state similar to that before the start of the test in Example 1. To the cleaned machine, a developer obtained by mixing 4 parts of Toner (A) obtained above and 96 parts of Carrier (I) obtained above using a Turbler mixer was charged. The doctor blade was not grounded, the gap between the doctor blade and the developing cylinder was adjusted to 0.34 mm and the toner recycling path was connected to the waste toner collecting tank. The copying machine was operated to obtain 50,000 copies. Thereafter, three copies of 100% solid image (A3 size) and three copies of 100% white image (A3 size) were produced to evaluate the uniformity in the density of the solid images and the background stains of the white images. The results are summarized in Table 3. The background stains were just above the permissible level. The uniformity of the solid images was, however, not in a permissible level. After the production of copies, the developing sleeve was observed with naked eyes. The sleeve was found to be fouled (the optical density of the sleeve surface was over 0.3).

COMPARATIVE EXAMPLE 2

The copying machined after Comparative Example 1 was cleaned into the state similar to that before the start of the test in Example 1. To the cleaned machine, a developer obtained by mixing 4 parts of Toner (A) obtained above and 96 parts of Carrier (I) obtained above using a Turbler mixer was charged. The doctor blade was not grounded, the gap between the doctor blade and the developing cylinder was adjusted to 0.34 mm and the toner recycling path was connected to the developing unit. The copying machine was operated to obtain 50,000 copies. Thereafter, three copies of 100% solid image (A3 size) and three copies of 100% white image (A3 size) were produced to evaluate the uniformity in the density of the solid images and the background stains of the white images. The results are summarized in Table 3. The background stains and the uniformity of the solid images were not in a permissible level. After the production of copies, the developing sleeve was observed with naked eyes. Black deposits were found on the entire surface of the sleeve.

TABLE 3

| Example No. | Doctor blade | Recovered toner | Gap (mm) | Toner | Uniformity of solid image | Background stains |
|---|---|---|---|---|---|---|
| 1 | grounded | fed to collecting tank | 0.34 | A | 0.06 | 4 |
| 2 | grounded | recycled to developing unit | 0.34 | A | 0.10 | 4 |

TABLE 3-continued

| Example No. | Doctor blade | Recovered toner | Gap (mm) | Toner | Uniformity of solid image | Background stains |
|---|---|---|---|---|---|---|
| 3 | grounded | recycled to developing unit | 0.34 | B | 0.18 | 4.5 |
| 4 | grounded | fed to collecting tank | 0.48 | A | 0.12 | 4 |
| Comp. Ex. 1 | not grounded | fed to collecting tank | 0.34 | A | 0.25* | 3.5 |
| Comp. Ex. 2 | not grounded | recycled to developing unit | 0.34 | A | 0.39* | 3* |

*impermissible level

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. An image forming apparatus, comprising a latent image bearing member, and a developing unit which comprises:

a developer bearing member disposed adjacent to said latent image bearing member to define a developing zone therebetween, said developer bearing member being configured to carry a two-component developer including a toner and a carrier on its surface and to convey the developer to said developing zone, so that the latent image on said latent image bearing member is developed with the toner in said developing zone; and a developer regulating member configured to regulate the amount of the developer carried and conveyed by the developer bearing member toward said developing zone;

wherein that portion of said toner which has a particle diameter of 2.0–4.0 $\mu$m accounts for 30–70% of a total number thereof, and wherein said developer regulating member is directly grounded so that when said developer bearing member is applied with a bias voltage, an electric field is formed between the developer regulating member and said developer bearing member, whereby toner deposits on said developer bearing member are transferred to said developer regulating member.

2. An image forming apparatus according to claim 1, wherein said toner comprises a colorant and a binder resin containing a polyester resin.

3. An image forming apparatus according to claim 2, wherein said binder resin additionally contains a styrene-(meth)acrylic copolymer resin.

4. An image forming apparatus according to claim 1, further comprising a collection mechanism for recovering toner used in said developing zone and remaining on said latent image bearing member, and a recycling mechanism for returning at least part of said recovered toner to said developing unit.

5. An image forming apparatus according to claim 1, wherein said developer regulating member is disposed to form a gap of 0.4 mm or less between said developer regulating member and said developer bearing member.

6. A method of developing an electrostatic latent image on an image bearing member, comprising:

feeding a two-component developer including a toner and a carrier to a developing unit having a developing member to permit said developing member to bear the developer;

contacting the developer carried by said developing member with a developer regulating member to regulate the amount of the developer carried by said developing member; and while applying a bias voltage to said developing member, contacting the developer whose amount has been regulated by said developer regulating member with said latent image on said image bearing member to develop said latent image with the toner;

wherein that portion of the toner which has a particle diameter of 2.0–4.0 $\mu$m accounts for 30–70% of a total number thereof, and wherein said developer regulating member is directly grounded such that when said developing member is applied with the bias voltage, an electric field is formed between said developer regulating member and said developing member, whereby toner deposits on said developing member are transferred to said developer regulating member.

7. A method according to claim 6, wherein the toner comprises a colorant and a binder resin containing a polyester resin.

8. A method according to claim 7, wherein said binder resin additionally contains a styrene-(meth)acrylic copolymer resin.

9. A method according to claim 6, further comprising recovering the toner remaining on said image bearing member after the contact with the developer, and recycling at least part of said recovered toner to said developing unit.

10. A method according to claim 6, wherein said developer regulating member is disposed to form a gap of 0.4 mm or less between said developer regulating member and said developer bearing member.

11. The image forming apparatus according to claim 2, wherein said binder resin is used in combination with an olefin polymer or an olefin copolymer.

12. The image forming apparatus according to claim 3, wherein said binder resin contains said styrene-(meth) acrylic copolymer resin in an amount of 5–50 parts by weight, based on 100 parts by weight of said polyester resin.

13. The image forming apparatus according to claim 2, wherein said binder resin has a glass transition temperature of 63° C. or less.

14. The image forming apparatus according to claim 2, wherein said colorant is a pigment and is present in an amount of from 0.1–30 parts by weight, based on 100 parts by weight of the binder resin.

15. The image forming apparatus according to claim 2, wherein said colorant is a dye and is present in an amount of from 0.05–10 parts by weight, based on 100 parts by weight of the binder resin.

16. The image forming apparatus according to claim 1, wherein said toner comprises a charge controlling agent.

17. The image forming apparatus according to claim 16, wherein said charge controlling agent is selected from the group consisting of organometallic compounds, chelate compounds.

18. The image forming apparatus according to claim 16, wherein said charge controlling agent is in the form of particles having a number average diameter of 3 $\mu$m or less.

19. The image forming apparatus according to claim 16, wherein said charge controlling agent is present in an amount of 0.1–20 parts by weight, based on 100 parts by weight of the binder resin.

20. The image forming apparatus according to claim 1, wherein said toner comprises a release agent.

* * * * *